US005197299A

United States Patent [19]

Sohn et al.

[11] Patent Number: 5,197,299

[45] Date of Patent: Mar. 30, 1993

[54] WINDOW-TYPE AIR CONDITIONER

[75] Inventors: Myung D. Sohn, Kwachun; Kyeng H. Ro, Suweon, both of Rep. of Korea

[73] Assignee: Samsung Electronics Co., Ltd., Suweon, Rep. of Korea

[21] Appl. No.: 759,719

[22] Filed: Sep. 12, 1991

Related U.S. Application Data

[63] Continuation of Ser. No. 451,341, Dec. 18, 1989, abandoned.

[30] Foreign Application Priority Data

Dec. 17, 1988 [KR] Rep. of Korea ..... 88-20905

[51] Int. Cl.[5] ..... F25D 23/12

[52] U.S. Cl. ..... 62/262; 62/263; 312/101; 454/201

[58] Field of Search ..... 62/262, 263; 312/101; 98/94 AC; 454/201

[56] References Cited

U.S. PATENT DOCUMENTS

| | | | |
|---|---|---|---|
| 2,667,765 | 2/1954 | Harris et al. | 62/262 |
| 3,404,539 | 10/1968 | Laing | 62/262 |
| 3,416,329 | 12/1968 | Thomas | 62/262 |
| 3,465,539 | 9/1969 | Kidder Smith | 62/262 |
| 3,491,549 | 1/1970 | Oglesky | 62/262 |
| 4,051,693 | 10/1977 | Needham | 62/262 |
| 4,109,708 | 8/1978 | Imral | 165/48 R |
| 4,669,534 | 6/1987 | Maeda et al. | 62/262 |

OTHER PUBLICATIONS

Cool View's Inverted "L" Shaped Design, Quaser Company located at 1026 Pratt Blvd. OK Grove Village, Ill. 80007, Apr. 1989.

*Primary Examiner*—John Sollecito

*Attorney, Agent, or Firm*—Sterne, Kessler, Goldstein & Fox

[57] ABSTRACT

The present invention relates to a window-type air conditioner comprising a body provided with a first portion and a second portion, the portions being partitioned by a intermediate plate. The first portion includes an inlet portion for intaking air from an indoor room and an outlet portion for discharging heat exchanged (conditioned) air into the indoor room. The inlet and outlet portions are relatively thin and are mounted at a window of the room extending forward to communicate with the room and isolate the second portion from the window. The second portion includes an operating portion which is mounted at an outside wall of the room. This invention allows for greater visibility through the window in which the air conditioner is mounted, and greatly reduces the operational noise from entering the indoor room.

4 Claims, 2 Drawing Sheets

WINDOW-TYPE AIR CONDITIONER

This application is a continuation of application Ser. No. 07/451,341, filed Dec. 18, 1989 now abandoned.

BACKGROUND OF THE INVENTION

This invention is related to window-type air conditioner structures and specifically discloses a new window-type air conditioner structure with increased window exposure. This window-type air conditioner is designed for home, office or industrial use.

Window-type air conditioners generally include at least one exchanger, an evaporator, a blower, and a condenser. Typically, a window-type air conditioner includes an intake portion for sucking air from the inside of the room to be cooled, and a discharging portion for returning cooler conditioned air to the inside of the room.

Conventional air conditioners are usually contained in a rectangular shape structure in order to securely fit within the window recess. However, these rectangular shaped structures occupy a substantial section of the available window space. When a conventional rectangular type air conditioner structure is mounted on a window sill it generally limits visibility through the window and during daylight hours it blocks sunlight. Furthermore, conventional window-type air conditioners introduce considerable noise into the room being cooled during their operation. Finally, installation of conventional window-type air conditioners is sometimes costly and often times requires modification to existing window and adjacent wall structures.

U.S. Pat. No. 4,109,708, issued to Imral on Aug. 29, 1978, discloses another conventional window-type air conditioner structure. Imral suggests using a compartmentalized air conditioner structure allowing access to its various components, as well as allowing for additional motor cooling. This patent shows a vertical partition within the air conditioning housing for isolation of the condenser compartment. The condenser compartment has a supplemental inlet and an air corridor. The motor for driving the evaporator blower mounts on a partition panel within the air corridor. An access door, opposite to the partition panel, permits the entire assembly to be removed for servicing and to permit access to the other parts.

SUMMARY OF THE INVENTION

The present invention is designed to provide a window-type air conditioner for increasing window exposure and reducing operating noise. It is also designed to provide a window-type air conditioner having a body divided into an indoor unit to be mounted at the window and an outdoor unit to be mounted at an exterior wall of the room to be cooled.

The indoor unit includes a blower and an evaporator while the outdoor unit is provided with a condenser, a compressor, and a cooling means, wherein said indoor unit and outdoor unit are divided by a partition wall.

The present invention requires considerably less window space for mounting of the air conditioner. A flattened subdivided duct, including an inlet/return section and a cooling section, is the only section of the present window-type air conditioner which requires mounting within the confines of the window space. This substantially flat air duct communicates with the inside room to be air conditioned, while the remainder of the window-type air conditioner unit is contained in a structure located at an outside wall adjacent the window so as not to obstruct the remainder of the window.

This outside section contains the operating portion of the window-type air conditioner including a condenser, a compressor and a cooling means.

BRIEF DESCRIPTION OF THE DRAWINGS

The above and other aspects of the invention will be seen by the following description taken in connection with the accompanying drawings, in which.

DETAILED DESCRIPTION OF THE INVENTION

Figure 1:
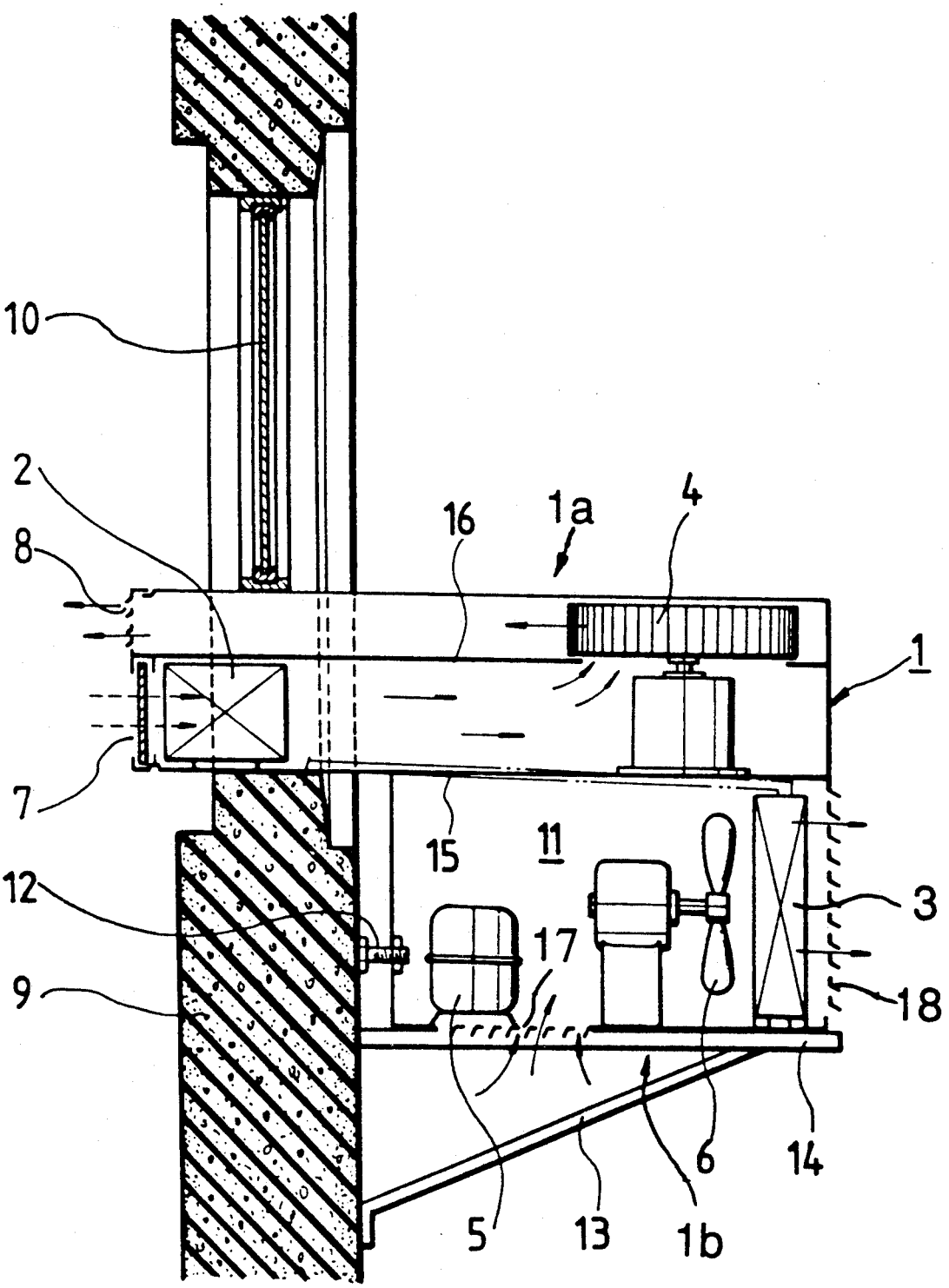
FIG. 1 is a cross-sectional view showing the window-type air conditioner according to the present invention installed in a window.

Referring now to FIG. 1, a window-type air conditioner of the present invention is provided with a body 1 which is partially located within the confines of window 10 and attached to wall 9. The body 1 includes an evaporator 2, a condenser 3, blowing unit or fan 4, compressor 5 and cooling unit or fan 6. Elements 2, 3, 4, 5, and 6 are conventional air conditioner elements as known to those of ordinary skill in the art. However, body 1 of the present invention employs the novel "L" type structure as shown in FIG. 1.

This "L" structure includes an intermediate plate 15 which divides the "L" structure into an upper portion 1*a* and a lower portion 1*b*. The upper duct-type portion 1*a* extends into and communicates with the interior of the room to be air conditioned. This forward extending duct is provided with an inlet portion 7 and an outlet portion 8. The inlet portion 7 and outlet portion 8 are divided by a partition wall 16. An evaporator 2 is mounted inside the duct toward the front section of the inlet portion 7.

Since the height of evaporator 2 is relatively small in comparison to a conventional unit, it has an increased width in order to maintain good heat exchanging efficiency. Evaporator 2 has a height similar to the height of thin inlet portion 7. The height of the duct including inlet portion 7 and outlet portion 8 is minimized in order to maximize the amount of window exposure ( e.g., visibility through the window or radiation of sunlight into the room).

The duct 1*a* also includes a blowing means 4 which is remotely mounted away from the window area. Its height spans both inlet portion 7 and outlet portion 8 within the duct. Blowing unit 4 draws air from inside the room through inlet portion 7, past evaporator 2 and subsequently returns conditioned air through outlet portion 8 into the room being air conditioned.

Figure 2:
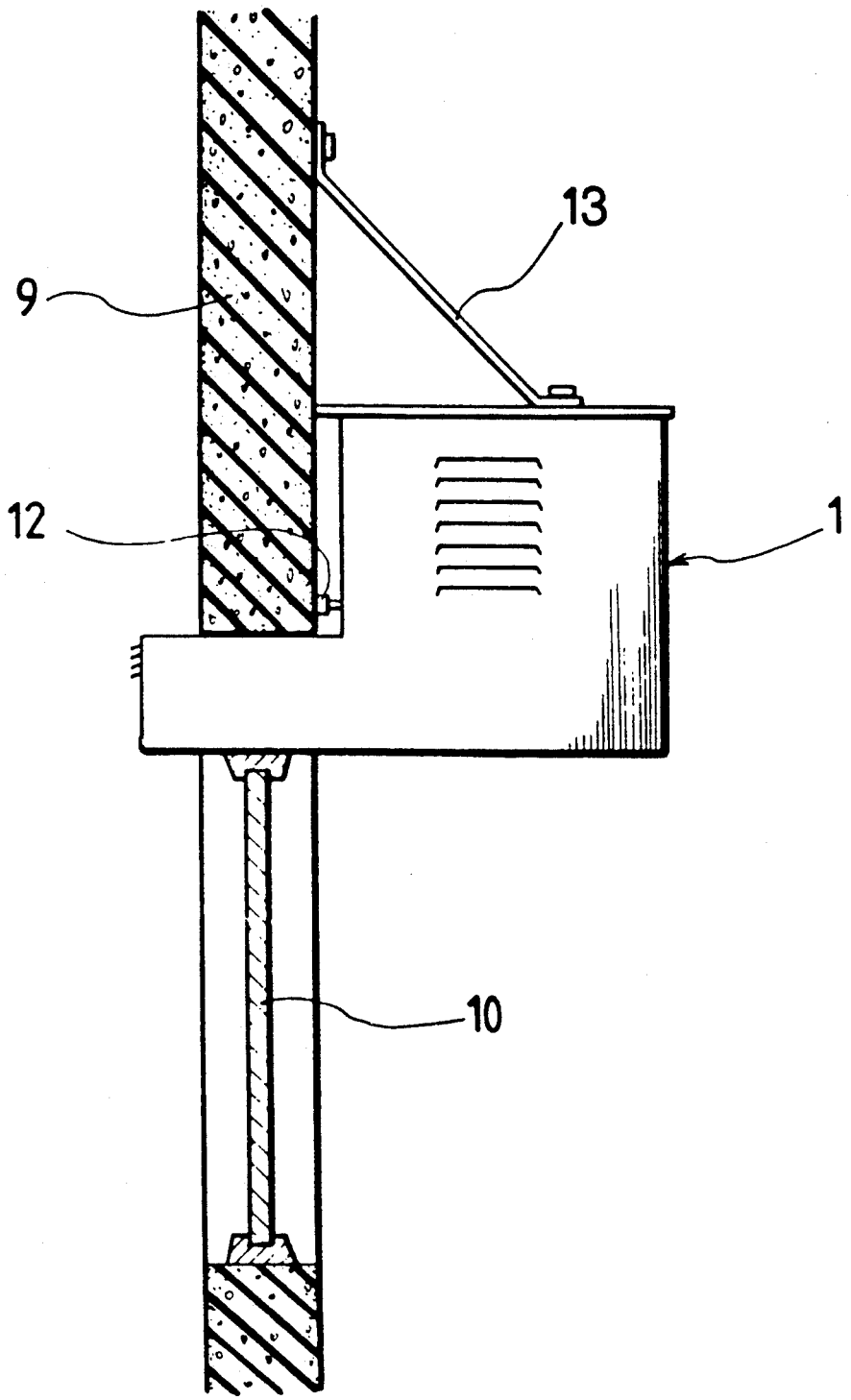
FIG. 2 illustrates another embodiment of the present invention.

As shown in both FIGS. 1 and 2, the remainder of body 1, which contains the condenser 3, compressor 5 and cooling unit 6, is isolated from the window by intermediate plate 15 of the duct section 1*a*. By locating elements 3, 5, and 6 outside the confines of the window space and isolating them from the window, the operating noise is substantially cut off from inside the room.

The embodiment of FIG. 1 enjoys an enhanced condensing efficiency since the evaporator 2 is located above condenser 3, thus allowing the condensing fluid to more easily flow downward into the condenser 3. Cooling unit 6 draws air into lower body portion 1*b* through inlet vents 17. The air is blown over and through the coils of condenser 3 and exits body portion 1*b* through outlet vents 18.

Installation of the present window-type air conditioner is accomplished by fixing the body 1 to wall 9 by a fastening means 12, such as one or more bolts. Fastening means 12 is located within an operating portion 11 of body 1. In addition to fastening means 12, the body is seated on plate 14 which is fixed to wall 9 by supporting member 13. As shown in FIGS. 1 and 2 the duct is secured between window 10 and a upper or lower sill of the window frame.

FIG. 2 shows another embodiment of the invention in which the body 1 is inverted, allowing operating portion 11 to be secured to a section of the wall 9 above the duct and window.

It should be understood that the elements described herein operate as conventional air conditioning components which typically include controls for suitable operation of the window-type air conditioner.

Clearly, modifications and variations of the present invention are possible in light of the above teachings. The aforementioned drawings and the description thereof were merely for the purposes of illustration and it is understood that various changes made or suggested by those skilled in the art can be made without departing from the spirit and scope of this invention.

What is claimed is:

1. A window type air conditioner mountable in a window for cooling air contained in an indoor space, comprising:

a first portion adapted and dimensioned to be mounted in a window including:

a first duct having an inlet end positioned adjacent to the indoor space, a second duct having an outlet end portion positioned adjacent to the indoor space, said second duct being adapted to allow air to freely flow therethrough to said outlet end, a fan having a motor portion and a blade portion, said fan disposed between said first and second duct, and an evaporator coil positioned at the inlet end of said first duct, said fan being configured to draw the air in the indoor space through the inlet end of said first duct into contact with said evaporator coil and then into said second cut where the air is returned to the indoor space through said outlet portion of said second duct;

a second portion having a compressor and a condenser coil; and a partition disposed between and completely isolating said first and second portions from each other, said partition being configured to have no openings or moving parts therein to thereby reduce noise that is generated by the compressor in said second portion from passing through said first portion and into the indoor space;

wherein said motor portion is mounted on said partition such that said fan is remotely mounted away from said inlet end and said outlet end, and said blade portion of said fan rotates in a plane parallel to said partition and is positioned inside said second duct.

2. The air conditioner of claim 1, wherein said second portion is positioned below the outside of said window thereby completely isolating said second portion from said window.

3. The air conditioner of claim 1, wherein the dimensions of said first duct and said second duct are optimized to maximize window exposure.

4. The air conditioner of claim 1, further comprising a common wall defining at least a portion of and separating said first and second ducts, said common wall extending into said first portion from said inlet and outlet ends to said fan, wherein said fan motor and fan blade portions lie on opposite sides of said common wall; and wherein said second duct is free of obstructions to air flow between said fan blade and said outlet end.

* * * * *